United States Patent [19]

Hynson

[11] 4,428,615

[45] Jan. 31, 1984

[54] CHAIR FOR IMMOBILE PATIENTS

[76] Inventor: Charles G. Hynson, 1995 Deborah Ave. NW., Largo, Fla. 33540

[21] Appl. No.: 326,660

[22] Filed: Dec. 3, 1981

[51] Int. Cl.[3] ..... A47C 13/00; A47K 11/06

[52] U.S. Cl. ..... 297/118; 297/DIG. 4; 5/81 R; 4/480; 4/483

[58] Field of Search ..... 4/478–480, 4/483; 297/118, DIG. 4; 5/81; 280/289 WC

[56] References Cited

U.S. PATENT DOCUMENTS

| | | | |
|---|---|---|---|
| 559,109 | 4/1896 | Stoltz | 4/483 |
| 2,153,866 | 4/1939 | Hess | 4/483 X |
| 2,587,068 | 2/1952 | Sanders | 5/81 B |
| 3,139,306 | 6/1964 | Jennings et al. | 297/DIG. 4 |
| 3,216,738 | 11/1965 | Bockus | 297/DIG. 4 |
| 3,285,619 | 11/1966 | Kitrell et al. | 5/81 R |
| 3,416,163 | 12/1968 | Jordan | 4/483 |
| 3,889,963 | 6/1975 | Brattgard | 297/DIG. 4 X |
| 3,967,328 | 7/1976 | Cox | 5/81 R |
| 4,067,409 | 1/1978 | Di Matteo et al. | 297/DIG. 4 X |
| 4,229,039 | 10/1980 | Day | 4/480 X |

*Primary Examiner*—Charles E. Phillips
*Attorney, Agent, or Firm*—Ronald E. Smith

[57] ABSTRACT

A chair for immobile patients. The chair has a high back portion, a seat portion that provides a toilet function, and a foot rest portion. The chair is specifically designed so that it is easily maneuvered from its reclined position to its upright position even when a patient is strapped therein. A pair of detachable auxiliary legs are provided that can be added to convert the chair into a wheel chair. The auxiliary legs can also be employed to stabilize the chair against lateral tipping when the chair is in its upright position on the edge of a bed. The seat portion is removable so that a portable toilet is thereby provided independently of the balance of the structural features of the chair. A pair of vertically spaced roller members, interconnected by a continuous belt, are provided to permit easy maneuvering of the chair relative to the surface of a bed when the chair is in its reclined position. The chair permits one person of ordinary strength to move an immobile patient, in the absence of hoists or other mechanical aids.

4 Claims, 4 Drawing Figures

CHAIR FOR IMMOBILE PATIENTS

BACKGROUND OF THE INVENTION

1. Field of the Invention

This invention relates generally to devices for transporting patients unable to move freely of their own volition, and more specifically relates to a device that provides the multiple functions of a chair, a toilet, and a wheel chair.

2. Description of the Prior Art

A search of United States patents found the following patents disclosing devices in the general field of this invention:

| Patentee | U.S. Pat. No. | Date of Issue |
|---|---|---|
| Grahn | 3,392,410 | 07-16-68 |
| Petrini | 3,940,808 | 03-02-76 |
| Michalowski | 4,138,750 | 02-13-79 |
| Murray | 4,202,063 | 05-13-80 |
| Petrini | 4,232,412 | 11-11-80 |

The search covered class/subclass 5/81,83,86,89,90,92 & 128/25.

Although the devices known heretofore have utility, the extent of such usefulness is limited in that many of the devices require hoists or other cumbersome and expensive apparatuses to accomplish the moving of the patient from one location to another, or to even re-position a patient from one position in bed to another. Moreover, although attempts have been made to combine toilet means with the earlier devices, the resulting structures have not found acceptance in the marketplace.

SUMMARY OF THE INVENTION

The longstanding but heretofore unfulfilled need for a device that supports patients comfortably while they are lying in bed as well as when they are sitting up in bed with their feet over the side of the bed, while also providing a toilet which the patient can use without traveling to a conventional toilet facility and which is easily converted into a wheel chair, is now provided in the form of a chair having a high back, a seat portion which includes a chamber for a bed pan, a leg and foot rest portion, and a pair of auxiliary, detachably mounted leg members that cooperate with the foot rest leg members to provide a wheel chair apparatus.

The auxiliary legs may also be mounted in a laterally extending disposition to stabilize the chair when it is in its upright position.

Vertically spaced roller members are also provided rearwardly of the back portion of the chair so that the chair can be rolled on the surface of a bed when the chair is being maneuvered.

It is therefore seen to be an important object of this invention to provide a multi-function chair useful in the context of persons who are substantially immobile.

Another object is to provide such a chair that can be handled by one person of ordinary strength so that the hoists of the prior art are not needed.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
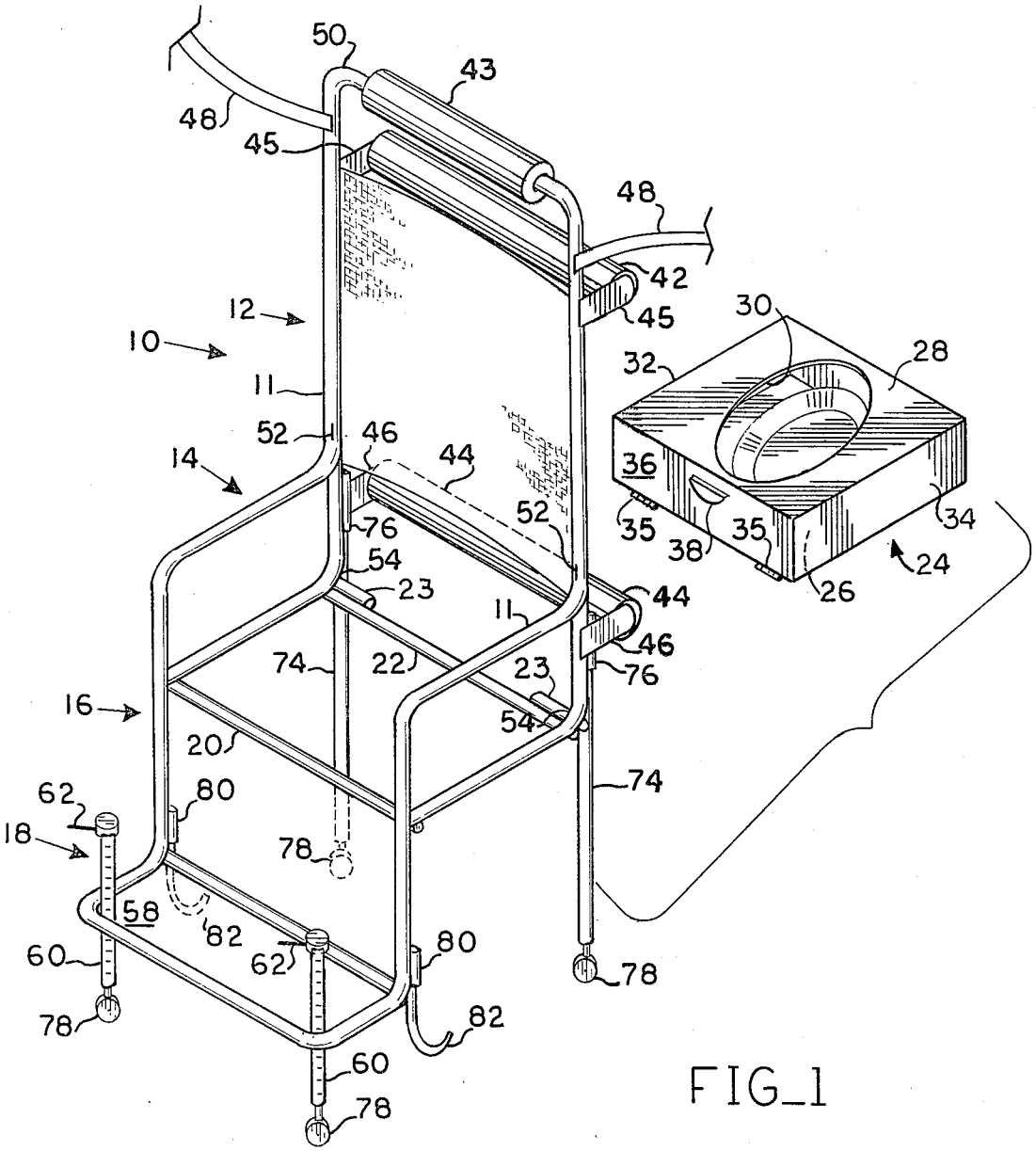
FIG. 1 is a perspective view of the preferred embodiment of the invention.

Referring now to FIG. 1, there it will be seen that the preferred embodiment of the invention is designated 10 as a whole. The chair 10 includes, generally, a vertically disposed high back portion 12, designed to support the patient along the entire length of his or her back, a horizontally disposed seat portion 14, a vertically disposed leg rest portion 16, and a horizontally disposed foot rest portion 18.

It should be noted that the frame 11 of the chair 10 can be formed of one continuous piece of tubular stainless steel or other suitable material.

Forward and rearward tubular cross bar members 20, 22 interconnect transversely spaced portions of the frame at the seat portion thereof, and provide support for drawer member 24. The drawer 24 includes bottom plate 26 that slideably rests atop the cross bars 20, 22, top plate 28 having a centrally disposed aperture 30 formed therein, and side walls 32, 34. The forward end wall 36 is hingedly mounted as at 35, 35, and a handle member 38 is provided thereon so that the wall 36 can be opened to allow removal of bed pan member 40. It is an important feature of this invention that the drawer assembly 24 can be used independently of the balance of the chair 10 assembly. For example, the drawer assembly 24, when used with suitable disposable plastic bags, not shown, provides a portable toilet. As such, it can be taken on camping trips, used in recreational vehicles, and so on. However, when the drawer assembly 24 is being used in a hospital or other health care facility, the drawer normally would not be removed from the chair since only the bed pan 40 would be removed as needed. Obviously, the patient need not be lifted or otherwise moved when the bed pan 40 is being placed into its functional position, or when the pan 40 is being removed. The drawer assembly 24 thus embodies an advance in the art of bed pan use.

Figure 2:
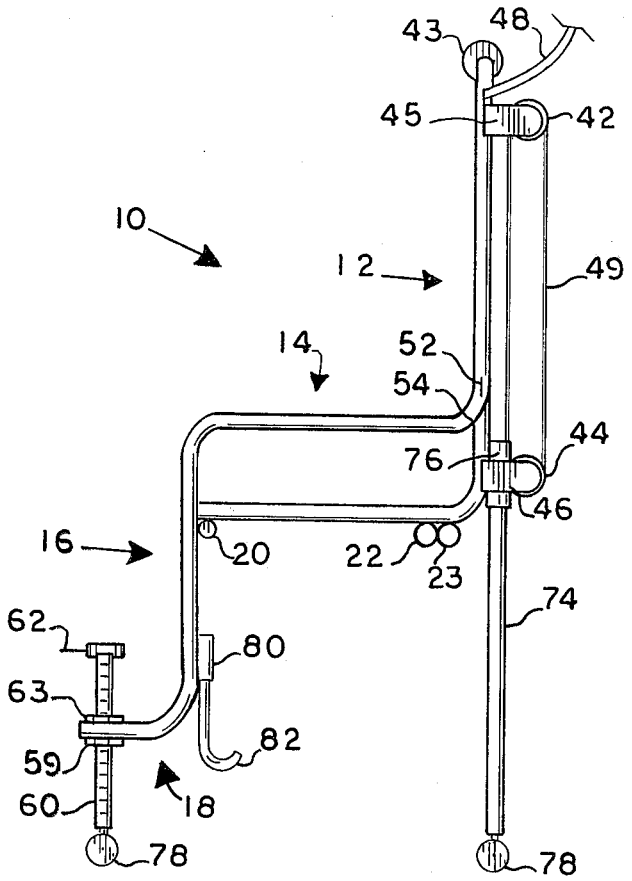
FIG. 2 is a side elevational view thereof, showing the auxiliary leg members which are employed to convert the novel chair into a wheel chair.
Figure 3:
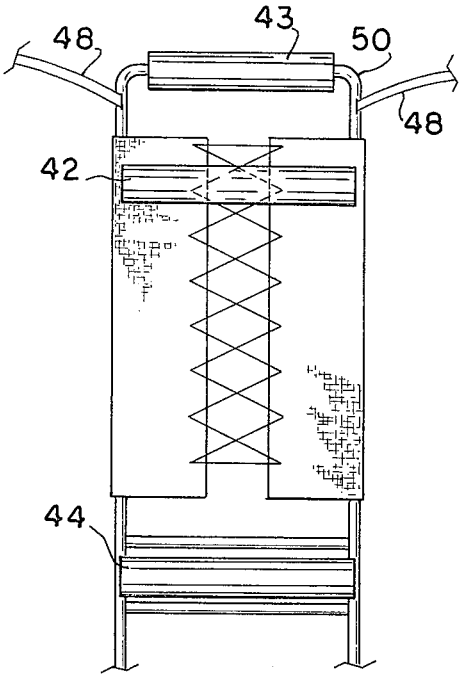
FIG. 3 is a rear elevational view.

A pair of vertically spaced roller members 42, 44 are rotatably mounted at right angles to the back portion 12 of the chair 10 as shown in FIGS. 1, 2 and 3. The mounting means therefor are rearwardly projecting ear members 45, 45 and 46, 46, respectively. A head rest 43, also in the form of a roller member, is provided at the top rail 50 of the chair 10. The chair also includes straps 48, 48 which are anchored at their respective ends on the top rail 50 of the frame as shown, and which are releasably secured to coupling members 52, 52 on the side rails of the frame. Accordingly, if straps are required, such straps are placed in crossing disposition across the patient's chest. Such cross strapping provides a high degree of comfort to both male and female patients.

When a patient desires to perform toilet functions, the patient first lies on his or her side and the chair 10 is placed on its side on the bed behind the patient. The chair 10 is brought into contact with the patient's body, and the patient's legs are bent at the knees and hip so that his or her legs conform to the shape of the chair. The chair is then turned onto its back, and the patient turns with the chair so that the patient is resting comfortably on the chair. The weight of the chair and patient will now be supported primarily by roller members 42, 44. As shown in FIG. 2, a continuous belt member 49 interconnects the roller members 42, 44 so that the weight of the patient is evenly distributed and so that the chair 10 can be moved easily relative to the surface of a bed, not shown, when the chair with the patient thereon is disposed on its back. Furthermore, the roller members 42, 44 also ease the strapping of the patient to the chair, since in the absence of the roller members the straps could be trapped under the chair, it being understood that the roller members, the back of the chair, and the surface of the bed collectively define a cavity into which one may reach to grasp the straps if needed.

After the patient has been strapped into the chair, the foot rest or leg rest portion of the chair is then grasped by the person helping the patient, and the chair, with the patient resting comfortably thereon, is pulled toward the foot of the bed. The chair rolls easily along on the roller members 42, 44, and the belt 49, so very little effort is needed to accomplish this chair pulling maneuver. The chair is pulled until the foot rest portion overhangs the edge of the bed. Next, the chair is uprighted by simply pressing down on either the leg or foot rest portions. The frame is gently bent as at 54, 54, (FIG 1) so the chair enters its upright position easily, without strain.

Once the chair is upright on the edge of the bed, the vertically adjustable leg members 60, 60 are adjusted to prevent tipping of the chair. Nut members 59,59, shown in FIG. 2, are preferably welded to the underside of the foot rest plate 58, at the opposite, forward corners thereof, for receiving the threaded shanks 60, 60 that form the leg members. Crank handles 62, 62 are mounted to the uppermost end of the shanks 60, 60 by a universal-joint arrangement so that such handles can be folded down when not in use. Lock nuts 63,63, disposed on the upper side of the foot rest plate 58, complete the leg assembly.

The patient may perform toilet functions when the chair is in its upright position at the foot of the bed after the leg members 60,60 have been adjusted to stabilize the chair.

When the patient needs to be transported from his or her bed to a different location, the novel chair 10 is easily and quickly converted into a wheel chair. As shown in FIGS. 1 and 2, a pair of auxiliary leg members 74, 74 cooperate with the foot rest leg members 60, 60 to provide the wheel chair function. The leg members 74, 74 are snap-fittingly coupled to the coupling members 76, 76 disposed at the rearward portion of the seat member 14. To attach the auxiliary legs 74, 74, the chair, with the patient lying thereon, is placed into its reclining position, i.e., with the patient lying on his back. The auxiliary legs 74, 74 and snapped into their respective coupling members 76, 76, and the chair is uprighted by pulling it toward the foot of the bed (or, of course, the chair is pulled on its roller members to the edge of the bed before the auxiliary legs are attached), and the chair is uprighted by pushing downward on the foot or leg rest portions thereof, just as when the chair is being placed into its upright position at the edge of the bed. The casters 78, 78 are of course self-locking casters and are locked before this maneuver is undertaken.

Figure 4:
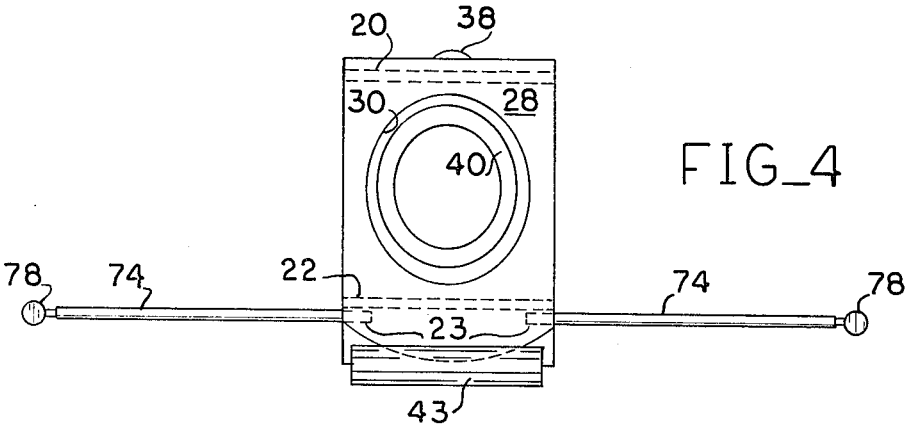
FIG. 4 is a top plan view.

As shown in FIG. 4, the auxiliary legs 74,74 may also be employed to stabilize the chair 10 when it is sitting on the edge of a bed. As shown in FIGS. 1 and 2, a pair of sleeve-like coupling members 23,23 are provided just rearwardly or transverse cross bar member 22 to detachably receive the legs 74, 74 when it is desired to stabilize the chair 10 when in its upright, non wheel chair configuration. The couplers 23, 23 are preferably identical in structure and function to the coupling members 76, 76 that detachably secure the auxiliary legs 74,74 when the chair 10 is used as a wheel chair.

If further stabilization is desired-though tests have demonstrated that legs 74,74, when laterally extended as shown in FIG. 4, provide very acceptable stabilization-yet another stabilization means can be employed. As shown in FIG. 1, another pair of couplers 80,80 (again, identical to couplers 23,23 and 76,76) may be provided rearwardly of the leg portion 16 of the chair 10. A pair of "J"-shaped hook members, 82,82 are slideably received within the couplers 80,80, and are spring loaded so as to be under tension. Thus, the chair 10 is further stabilized by pulling down on the hook members 82,82, positioning the respective hook members 82,82 in hooking relation to the underside of a bed rail-not shown-and releasing the hooks 82,82. The bias means-not shown-will put the hooks 82,82 into gripping relation with the bed frame. When the hooks 82,82 are not in use, they are simply pivoted into non-interfering relation with the environment of the chair.

The back portion 12 is preferably canvas-backed, and the canvas is strung as shown in FIG. 3. However, the chair 10 could be made of high impact plastic and the back could be made of a more flexible plastic. Accordingly, patients could be wheeled into shower stalls and bathed while resting comfortably in the chair 10. The chair would then be towel-dried along with the patient so that the patient could be returned to bed while continuing to rest on the chair 10.

The novel chair has been tested and found to be comfortable over extended periods of time, and easy to handle. Considerable time is saved in moving patients from a reclining position to a sitting position for toilet functions, and in transporting the patient into or out of his or her room. More importantly, patients who have endured considerable discomfort when being moved by prior art methods will experience no discomfort when being moved while resting comfortably in the inventive chair. The removable bed pan allows the toilet chore to be performed more pleasantly vis a vis prior art methods, and thus reduces the amount of aggravation involved in performing waste functions while bed ridden.

All of the features combine to provide a highly versatile apparatus that is inexpensive to manufacture and thus inexpensive to purchase.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A chair for immobile or substantially immobile patients, of the type having an elongate, vertically disposed back portion, a horizontally disposed seat portion formed integrally therewith, a vertically disposed leg rest portion formed integrally therewith, a horizontally disposed foot rest portion formed integrally therewith, and a pair of upstanding forward leg members operatively connected to said foot rest portion, wherein the improvement comprises:

a pair of upstanding, detachably mounted auxiliary leg members disposed rearwardly of said forward leg members, said chair being used as a seat when disposed in an upright position on the edge of a bed and being used as a wheel chair when said auxiliary legs have been attached thereto, a first coupling means comprising upstanding first and second sleeve members disposed rearwardly of said forward leg members, each sleeve member adapted to telescopically receive an associated one of said auxiliary leg members, a pair of vertically spaced, rotatably mounted roller members disposed rearwardly of the back portion of said chair, a continuous belt member disposed in interconnecting relation around said roller members so that said chair, when in its reclining position can be moved relative to a bed surface, by engagement of said roller members and said belt member on the bed surface, a forward cross bar member transversely disposed in interconnecting relation between transversely spaced portions of said chair that at least in part define the seat portion of said chair, a rearward cross bar member spaced rearwardly of the forward cross bar member, and transversely disposed in interconnecting relation between said transversely spaced portions of said chair, a second coupling means disposed adjacent said rearward crossbar member, rearwardly thereof, said second coupling means comprising a first and second sleeve member, both of said sleeve members telescopically receiving a respective end of said auxiliary leg members, and said second coupling members aligned so that when said auxiliary leg members are releasably attached thereto, said auxiliary leg members extend laterally relative to said chair, from the lowermost surface thereof, thereby stabilizing the chair when it is in its upright configuration on the edge of a bed, being used as a seat.

2. The chair of claim 1 further comprising, a third, vertically disposed, coupling means disposed adjacent said respective leg rest portions of said chair, rearwardly thereof, a pair of hook-shaped members slideably received within respective ones of said third coupling means, bias means for imparting tension to both of said hook-shaped members so that they have a tendency to retract into said third coupling means, so that the chair may be stabilized by hooking said hook-shaped members to the underside of a bed railing.

3. The chair of claim 2, wherein said leg members associated with the foot rest portion are vertically adjustable.

4. The chair of claim 3, wherein a pair of elongate, flexible strap members are fixedly secured at their respective ends to the uppermost rail of said chair, on transversely spaced portions thereof, and wherein the distal ends of said members are releasably secured to the frame of said chair adjacent the seat portion thereof so that a patient can be secured in said chair by securing said strap members in crossing relation to one another.

* * * * *